US007048557B2

(12) United States Patent
Yen

(10) Patent No.: US 7,048,557 B2
(45) Date of Patent: May 23, 2006

(54) PLUG WITH A RETRACTABLE CAP HAVING A CONCAVE EDGE ON A BOTTOM PORTION TO PREVENT BREAKAGE

(76) Inventor: Chun-Chang Yen, No. 8, Lane 247, Nieu Pu Road, Hsinchu City (TW)

( * ) Notice: Subject to any disclaimer, the term of this patent is extended or adjusted under 35 U.S.C. 154(b) by 0 days.

(21) Appl. No.: 10/838,264

(22) Filed: May 5, 2004

(65) Prior Publication Data

US 2005/0250361 A1 Nov. 10, 2005

(51) Int. Cl.
*H01R 13/44* (2006.01)
*H01R 13/68* (2006.01)
*H01R 33/95* (2006.01)

(52) U.S. Cl. ..... 439/140; 439/622

(58) Field of Classification Search ..... 439/140, 439/139, 136, 622, 621; 174/135
See application file for complete search history.

(56) References Cited

U.S. PATENT DOCUMENTS 5,320,563 A * 6/1994 Liao ..... 439/622
5,816,858 A * 10/1998 Kazarian et al. ..... 439/621
5,853,301 A * 12/1998 Wang ..... 439/622
6,033,252 A * 3/2000 Hood et al. ..... 439/374
6,652,321 B1 * 11/2003 Liu ..... 439/622

* cited by examiner

*Primary Examiner*—Chandrika Prasad
(74) *Attorney, Agent, or Firm*—Rosenberg, Klein & Lee

(57) ABSTRACT

The invention relates to a secure cap of a plug, which includes a plug having inner fuses and a moveable cap. The cap is provided with an under convex edge near to the end. Hence, the cap can be bent, as bearing a downward force before the projections of the plug is broken for preventing the cap from being released or separated.

1 Claim, 4 Drawing Sheets

PLUG WITH A RETRACTABLE CAP HAVING A CONCAVE EDGE ON A BOTTOM PORTION TO PREVENT BREAKAGE

FIELD OF THE INVENTION

The present invention relates to an improvement of a plug, which has a secure cap being capable of preventing from releasing and lost.

BACKGROUND OF THE INVENTION

As shown in FIG. 1 to 4, a conventional plug (1) is provided with a pair of inward projections (11) for engaging with the end of a fuse cap (2). At the opening place of the cap (2), the fuse can be provided or replaced. In this state, even a little downward force presses the opening cap (2), as direction of arrow in FIG. 1, the projections (11) will be easily broken (as in FIG. 4). Hence, the cap (2) is going to be released from the plug (1) and can't be used in secure.

SUMMARY OF THE INVENTION

The present invention is to provide a secure cap of a plug, which can overcome the drawback of the prior art that the cap will be engaged with the plug firmly and the projections of the plug will not be broken. Now, accompanying with the following drawings, the character of the present invention will be described here and after.

DETAILED DESCRIPTION OF THE PREFERRED EMBODIMENT

Figure 2:
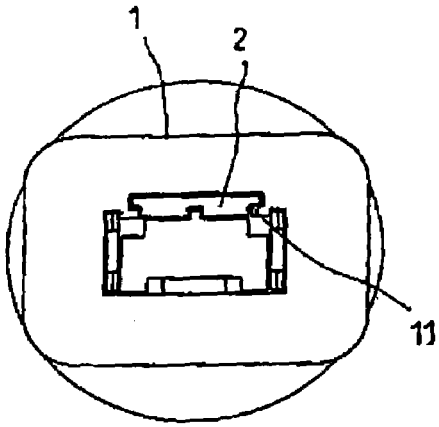
FIG. 2 PRIOR ART
FIG. 2 is a left side view of FIG. 1.
Figure 1:
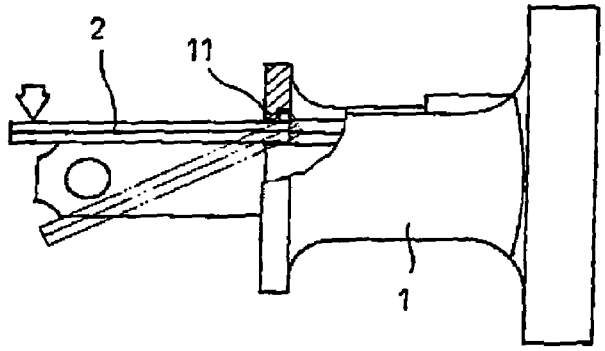
FIG. 1 PRIOR ART
FIG. 1 is a partly cross-sectional plan view showing a conventional plug with fuse and cap.
Figure 4:
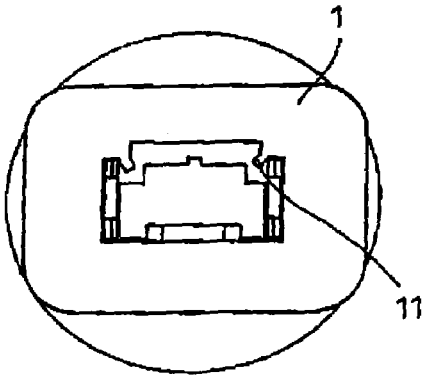
FIG. 4 PRIOR ART
FIG. 4 is a left side view showing the plug of FIG. 3.
Figure 3:
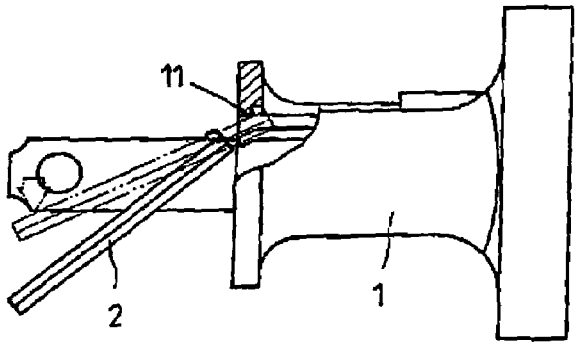
FIG. 3 PRIOR ART
FIG. 3 is a plan view of FIG. 2 showing the cap is released from the plug.
Figure 5:
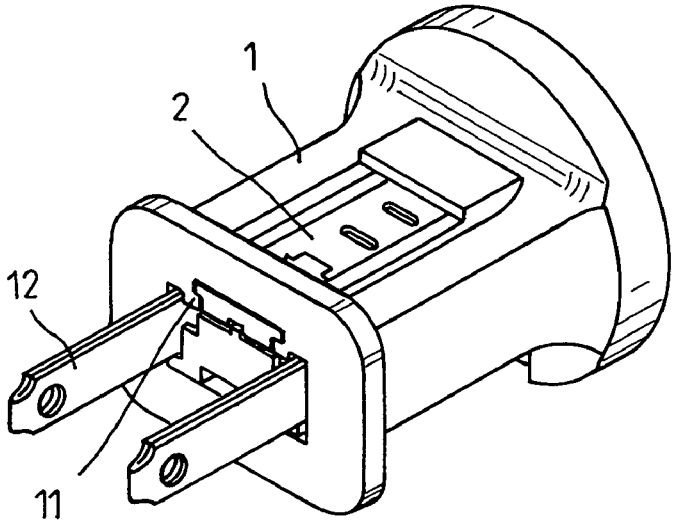
FIG. 5 is a perspective view showing a plug with fuse and cap according to the present invention.
Figure 6:
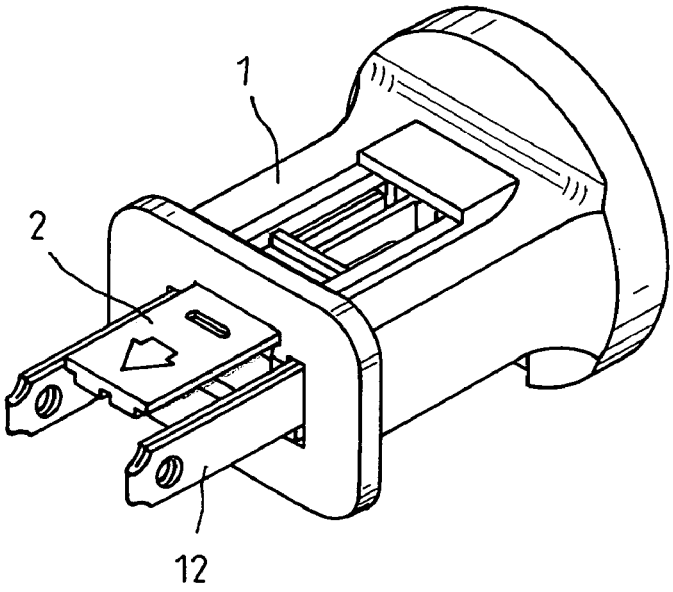
FIG. 6 is a perspective view of FIG. 6 showing the cap is pulled out.
Figure 7:
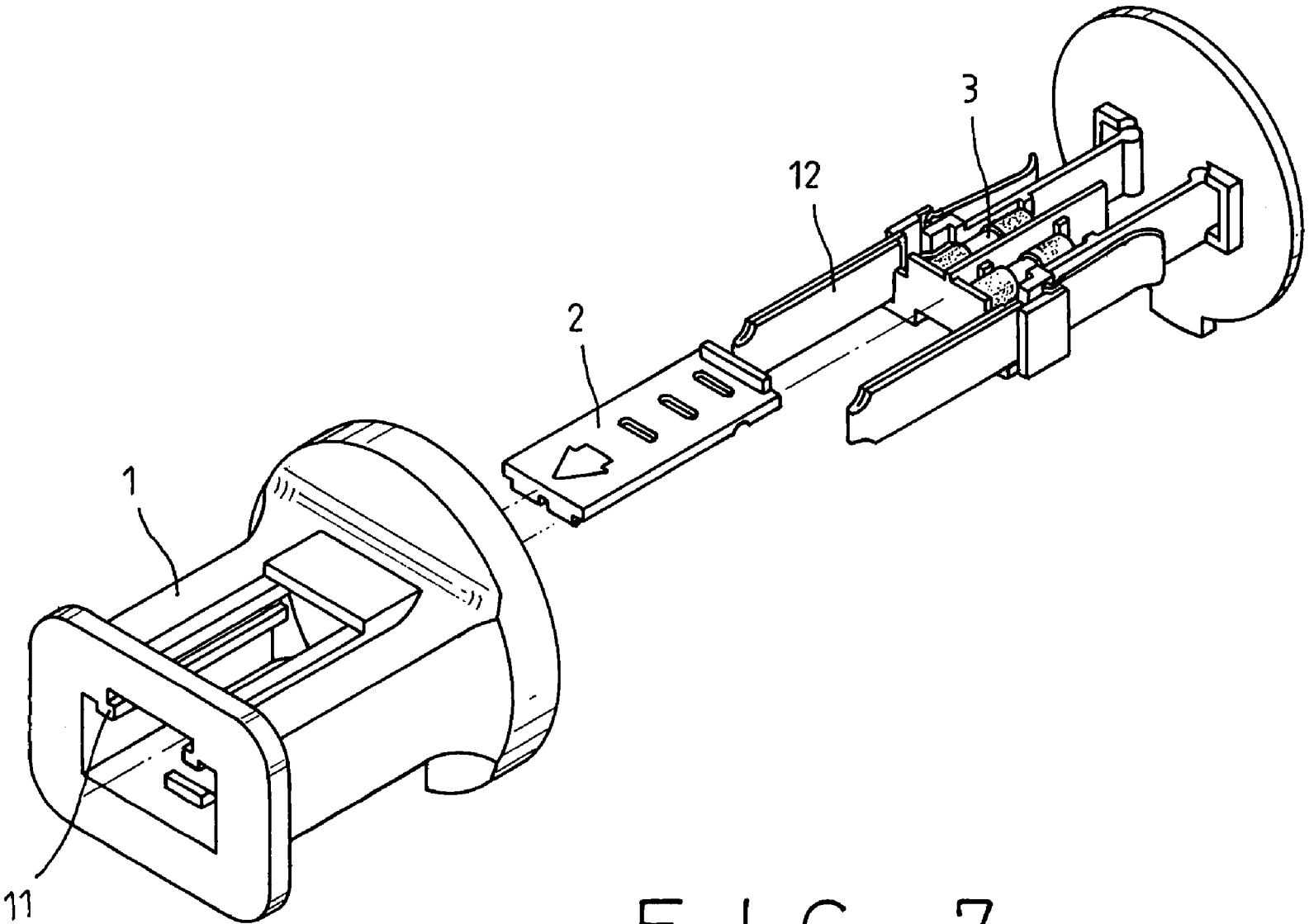
FIG. 7 is an exploded perspective view of FIG. 5.

Please referring to FIG. 5 to 7, the present invention includes a plug (1) with inner fuses (3) connecting with two metal slices (12). A moveable fuse cap (2) is provided on the plug (1) covering the fuses (3). A pair of inward projections (11) is provided at side of the plug (1) to engage with the end of the cap (2) for preventing the cap from being released.

Figure 8:
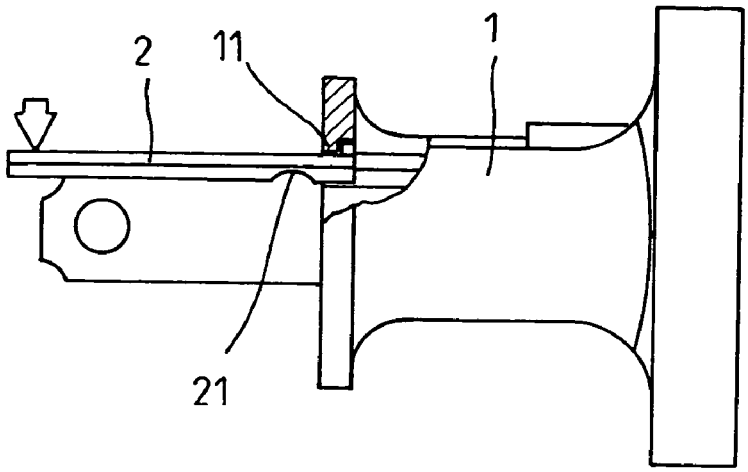
FIG. 8 is a partly cross-sectional plan view showing the assembled plug according to the present invention.
Figure 9:
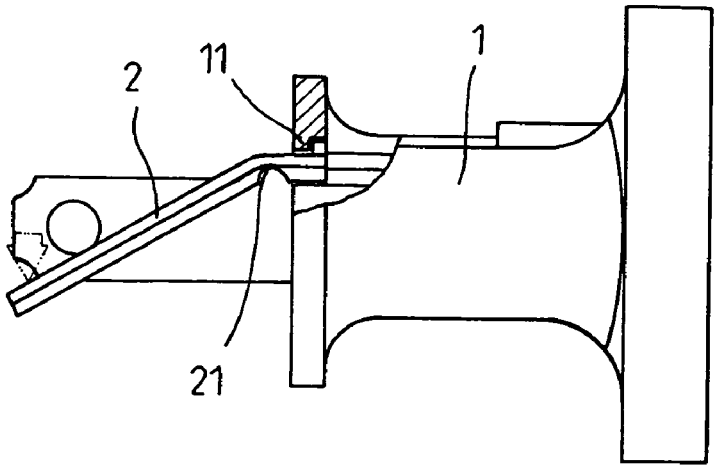
FIG. 9 is a plan view of FIG. 8 showing the cap is pressed downward.

The improvement of the invention is to provide a concave edge (21) under the cap (2), which is near to the end. As shown in FIGS. 8 and 9, when the cap (2) is pressed by a downward or upward force, the cap (2) will be bent before the projections (11) are broken. Hence, the cap is still engaged wit the plug (1) instead of being separated that overcomes the drawback of prior art.

Since the cap (2) is made of plastic, it can be recovered as a plate form to be pushed back for covering the fuses (3) for normal use.

Accordingly, the present invention overcomes the drawback of prior structure. It is obviously utilized and effective that should be allowed for patent.

I claim:

1. A plug comprising:

a plug defining therein a retractable cap slot for receiving a retractable cap, inward projections and inner fuses, said inner fuses contained within said plug, said retractable cap being locationally positioned on a top of said plug and being retractable between a first position in which said retractable cap is slidably displaced along a bottom portion from said plug and a second position in which said cap is retracted into said retractable cap slot, said retractable cap having a concave arcuate edge contour formed in said bottom portion of said retractable cap whereby a downward or upward bearing force can be applied to said retractable cap when in said first position without resulting in breakage of said inward projections.

* * * * *